US011318965B2

(12) United States Patent
Cepak et al.

(10) Patent No.: US 11,318,965 B2
(45) Date of Patent: May 3, 2022

(54) LOCOMOTIVE BOGIE HAVING AN ANTI-PITCHING GEOMETRY

(71) Applicant: Bombardier Transportation GmbH, Berlin (DE)

(72) Inventors: Werner Cepak, Vienna (AT); Andreas Bauer, Vienna (AT); Federic B. Carl, Kassel (DE); Primoz Neme, Vienna (AT)

(73) Assignee: Bombardier Transportation GmbH, Berlin (DE)

( * ) Notice: Subject to any disclaimer, the term of this patent is extended or adjusted under 35 U.S.C. 154(b) by 225 days.

(21) Appl. No.: 16/707,868

(22) Filed: Dec. 9, 2019

(65) Prior Publication Data

US 2020/0207381 A1 Jul. 2, 2020

Related U.S. Application Data

(60) Provisional application No. 62/785,425, filed on Dec. 27, 2018.

(51) Int. Cl.

| | |
|---|---|
| ***B61C 9/50*** | (2006.01) |
| ***B61F 3/04*** | (2006.01) |
| ***B61F 5/50*** | (2006.01) |
| ***B61F 5/52*** | (2006.01) |
| *B61C 3/00* | (2006.01) |

(52) U.S. Cl.

CPC ..... *B61C 9/50* (2013.01); *B61F 3/04* (2013.01); *B61F 5/50* (2013.01); *B61F 5/52* (2013.01); *B61C 3/00* (2013.01)

(58) Field of Classification Search

CPC ..... B61F 3/04; B61F 5/26; B61F 5/50; B61F 5/52; B61C 3/00; B61C 9/50

See application file for complete search history.

(56) References Cited

FOREIGN PATENT DOCUMENTS

| | | | | |
|---|---|---|---|---|
| CN | 101513882 | A | 8/2009 | |
| CN | 202413820 | U | 9/2012 | |
| CN | 103625498 | A | 3/2014 | |
| CN | 204432385 | U | 7/2015 | |
| CN | 204641744 | U | 9/2015 | |
| CN | 105584490 | A | 5/2016 | |
| CN | 106274919 | A | 1/2017 | |
| CN | 107254562 | A | 10/2017 | |
| DE | 2822991 | A1 | 11/1979 | |
| EP | 0308616 | A2 | 3/1989 | |
| EP | 0589866 | A1 | 3/1994 | |
| EP | 2569197 | B1 * | 5/2017 | ..... B61C 9/50 |
| GB | 2491334 | A | 5/2012 | |
| RU | 164732 | U1 | 10/2016 | |
| SU | 522979 | A1 | 7/1976 | |

* cited by examiner

*Primary Examiner* — Zachary L Kuhfuss

(74) *Attorney, Agent, or Firm* — The Webb Law Firm

(57) ABSTRACT

A bogie for a rail vehicle, such as a locomotive, includes a frame, two wheelsets and at least one drive unit. The drive unit is mounted to the frame and to the wheelset. A motor is at least partially supported by the frame while a gearbox to which it is flexibly connected has a main gear mounted on the one wheelset as well as a pinion for driving the main gear. The gearbox is connected to the frame by a reaction rod placed away from the wheel-axle on which the gearbox is mounted. The reaction rod, which defines an axis, is aligned so that its axis extends substantially through a center of the bogie when projected in a longitudinal-vertical plane bisecting the bogie.

14 Claims, 5 Drawing Sheets

LOCOMOTIVE BOGIE HAVING AN ANTI-PITCHING GEOMETRY

CROSS-REFERENCE TO RELATED APPLICATION

This application claims priority to U.S. Provisional Application No. 62/785,425, filed Dec. 27, 2018, the disclosure of which is incorporated herein in its entirety.

FIELD OF THE INVENTION

The present invention generally relates to the field of railroad transportation. More specifically, the invention relates to a locomotive bogie having a semi-suspended drive arrangement with an anti-pitching geometry.

BACKGROUND OF THE INVENTION

Locomotives have to pull extremely heavy loads. To do so, they must not only develop high power, but they must also be able to efficiently transform this power into a tractive force. This tractive force is developed at the wheel-rail interface and is directly dependent on the weight of the locomotive distributed on all its driven wheels.

There is however a limit on the weight of a locomotive since rail wear is proportional to the weight of vehicles travelling on them. In some European countries especially, train operators are being charged track access charges as a function of the weight of the vehicles. In particular, track access charges are sensitive to unsprung mass, which has a large influence on rail wear. Consequently, there are benefits to decreasing unsprung mass while ensuring transferring the maximum tractive force.

Decreasing unsprung mass is possible by adopting either a fully suspended or a semi-suspended drive unit rather than a non-suspended or nose-suspended drive unit. One drawback of fully suspended drive units is that they end up being quite expensive. Semi-suspended drive units, although cheaper, typically induce a pitching torque and pitching movement on the bogie during acceleration. This pitching torque influences the deflection of the springs of the primary suspension by compressing the primary suspension on one wheelset and by elongating the primary suspension on the other wheelset. This pitching torque also redistributes in a non-optimum manner the weight on the wheels. This compression of the primary suspension caused by the pitching movement is detrimental for locomotives since the available travel of the primary suspension is already limited to prevent derailment.

Chinese patent application no. CN 105584490 shows a rail vehicle bogie having two semi-suspended drive units each using a suspended hydraulic motor and a semi-suspended gearbox. The gearbox is suspended by a connecting rod to the frame. When a tractive force is generated, a reaction force in the reaction rod induces a pitching moment around a center of the bogie, reducing the suspension travel and increasing the weight on one wheelset while increasing the increasing the suspension travel and decreasing the weight on the other wheelset.

Chinese utility model no. CN 204641744 depicts a rail vehicle bogie having two semi-suspended drive units each using a suspended electric motor and a semi-suspended gearbox. The gearbox is suspended by a connecting rod to the frame. When a tractive force is generated, a reaction force in the reaction rod induces a pitching moment around a center of the bogie, reducing the suspension travel and increasing the weight on one wheelset while increasing the increasing the suspension travel and decreasing the weight on the other wheelset.

None of the prior art addresses the problem of the pitching movement of the bogies during generation of a tractive force and its associated reduced primary suspension travel and non-optimal weight distribution on the wheels.

There is therefore a need for a semi-suspended design that addresses the problems created by the pitching torque during force generation.

SUMMARY OF THE INVENTION

Generally, the present invention provides a bogie for rail vehicles that overcomes or mitigates one or more disadvantages of known bogies, or at least provides a useful alternative.

The invention provides the advantages of potentially reducing the unsprung masses, thereby potentially reducing European track access charges.

The invention also provides the advantage of not further reducing the travel of the primary suspension by reducing or eliminating a pitching torque on the bogie.

In one preferred and non-limiting embodiment or example, there is provided a bogie for a rail vehicle. The bogie may comprise a bogie frame, a first and a second wheelsets and a first drive unit. The first and the second wheelsets, which are adapted to roll on railway tracks, may support a different end of the bogie frame. The first drive unit may be mounted to the frame and to the first wheelset. The first drive unit may comprise a motor, a gearbox and a driveshaft. The motor may be at least partially supported by the bogie frame. The gearbox may have a main gear mounted on the first wheelset, for example on its axle, as well as a pinion for driving the main gear. The gearbox may have a mounting point distal from the first wheelset. The driveshaft may be flexibly attached at one end to a rotor of the motor and resiliently at the other end to the pinion. The driveshaft may be operative to transfer a torque from the motor to the pinion. The first reaction rod may have a first end and a second end defining an axis. The first reaction rod may be connected to the bogie frame at its first end and to the mounting point of the gearbox at its second end. When projected in a longitudinal-vertical plane bisecting the bogie, the first reaction rod may be aligned so that its axis extends substantially through a center of the bogie.

Optionally, the reaction rod may be substantially vertically aligned. The reaction rod may be positioned substantially halfway between spinning axes of the first and the second wheelsets.

The driveshaft may be connected to the rotor on a side of the motor distal the gearbox and then extends through the rotor to attach to the pinion. The driveshaft may be mounted so as to allow a misalignment between the motor and the gearbox. To allow this misalignment, the driveshaft may be connected to the motor through a spherical connection and to a pinion of the gearbox through a resilient connection such as a flexible disc connection.

Optionally, especially when the rail vehicle is a locomotive, the bogie may further comprise a second drive unit which is mounted to the frame and to the second wheelset. Similar to the first drive unit, the second drive unit comprises a motor, a gearbox and a driveshaft. The motor of the second drive unit is at least partially mounted to the bogie frame. The gearbox of the second drive unit has its main gear mounted on the second wheelset, for example on its axle, and its pinion for driving the main gear. This gearbox has a mounting point distal from the second wheelset. The driveshaft is flexibly attached at one end to the rotor of the motor of the second drive unit and resiliently at the other end to the pinion of the gearbox of the second drive unit. The driveshaft is operative to transfer a torque from the motor to the pinion. The second reaction rod has a first end and a second end defining its own axis. The second reaction rod is connected to the bogie frame at its first end and to the mounting point of the gearbox of the second drive unit at its second end. The second reaction rod is aligned so that its axis extends substantially through the center of the bogie when projected in the longitudinal-vertical plane.

Optionally, the second reaction rod may be substantially vertically aligned and may be positioned substantially halfway between the spinning axles of the first and the second wheelsets.

The center of the bogie may be longitudinally located at a mid-distance between the first and the second wheelsets and optionally in the vertical direction substantially at a height of the spinning axes of the axles of the first and the second wheelsets. Optionally, the center of the bogie may also correspond to a center of gravity of the bogie.

Further preferred and non-limiting embodiments or examples of a bogie for a rail vehicle are characterized in one or more of the following numbered clauses.

Clause 1: A bogie for a rail vehicle comprising: a bogie frame; a first wheelset and a second wheelset each adapted to roll on railway tracks and supporting a different end of the bogie frame; a first drive unit mounted to the frame and to the first wheelset, the first drive unit having: a motor at least partially supported by the bogie frame, the motor having a rotor; a gearbox having a main gear mounted on the first wheelset, for example on its axle, and a pinion driving the main gear, the gearbox having a mounting point distal from the first wheelset; a driveshaft attached at one end to the rotor and at the other end to the pinion, the driveshaft being operative to transfer a torque from the motor to the pinion; and a first reaction rod having a first end and a second end defining an axis, the first reaction rod being connected to the bogie frame at the first end and to the mounting point of the gearbox at the second end, wherein, when projected in a longitudinal-vertical plane bisecting the bogie, the first reaction rod is aligned so that the axis extends substantially through a center of the bogie.

Clause 2: The bogie of clause 1, wherein the reaction rod is substantially vertically aligned.

Clause 3: The bogie of clause 2, wherein the reaction rod is positioned substantially halfway between the first wheelset and the second wheelset.

Clause 4: The bogie of clause 2 or 3, wherein the driveshaft is connected to the rotor on a side of the motor distal to the gearbox and extends through the rotor to attach to the pinion.

Clause 5: The bogie of any of clauses 1 to 4, wherein the driveshaft is mounted so as to allow a misalignment between the motor and the gearbox.

Clause 6: The bogie of clause 5, wherein the driveshaft is connected to the motor through a spherical connection.

Clause 7: The bogie of clause 6, wherein the driveshaft is resiliently mounted to a pinion of the gearbox.

Clause 8: The bogie of any of clauses 1 to 7, wherein the center of the bogie is longitudinally located at a mid-distance between a first spinning axis of the first wheelset and a second spinning axis of the second wheelset.

Clause 9: The bogie of clause 8, wherein the center of the bogie is vertically located substantially at a same height as the first spinning axis of the first wheelset.

Clause 10: The bogie of any of clauses 1 to 7, further comprising: a second drive unit mounted to the frame and to the second wheelset, the second drive unit having: a motor at least partially supported by the bogie frame, the motor having a rotor; a gearbox having a main gear mounted on the first wheelset, for example on its axle, and a pinion driving the main gear, the gearbox having a mounting point distal from the second wheelset; a driveshaft attached at one end to the rotor and at the other end to the pinion, the driveshaft being operative to transfer a torque from the motor to the pinion; and a second reaction rod having a first end and a second end defining an axis, the second reaction rod being connected to the bogie frame at the first end and to the mounting point of the gearbox of the second drive unit at the second end, the second reaction rod being aligned so that the axis extends substantially through the center of the bogie when projected in the longitudinal-vertical plane.

Clause 11: The bogie of clause 10, wherein the second reaction rod is substantially vertically aligned.

Clause 12: The bogie of clause 11, wherein the second reaction rod is positioned substantially halfway between the first wheelset and the second wheelset.

Clause 13: The bogie of any of clauses 10 to 12, wherein the rail vehicle is a locomotive.

Clause 14: The bogie of any of clauses 10 to 13, wherein the center of the bogie is longitudinally located at a mid-distance between spinning axes of the first and second wheelsets.

Clause 15: The bogie of clause 14, wherein the center of the bogie is vertically located substantially at a same height as the first spinning axis of the first wheelset.

BRIEF DESCRIPTION OF DRAWINGS

These and other features of the present invention will become more apparent from the following description in which reference is made to the appended drawings wherein.

DETAILED DESCRIPTION OF THE INVENTION

Figure 1:
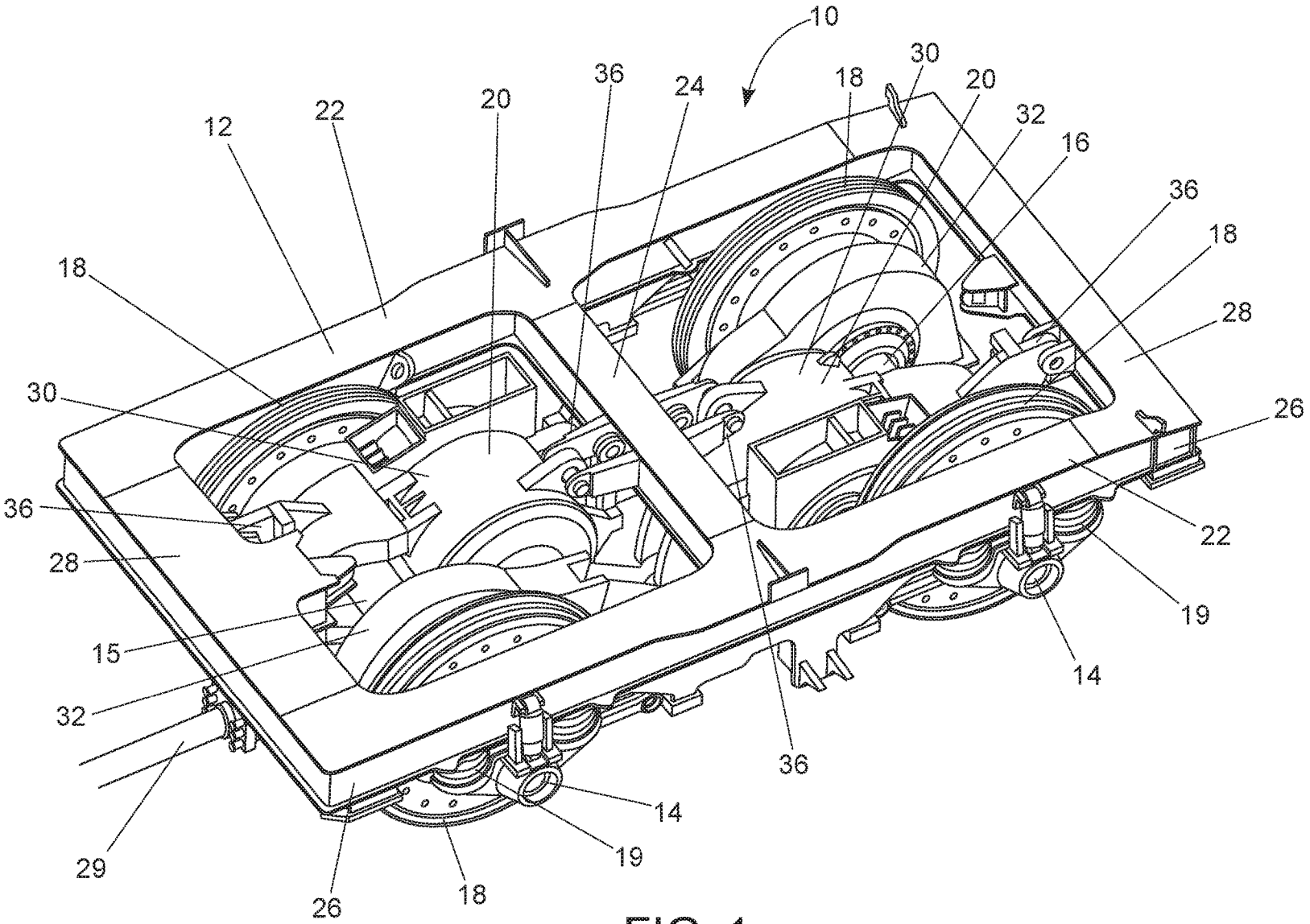
FIG. 1 is an axonometric view from the top of a rail vehicle bogie in accordance with the principles of the present invention.

FIG. 1, now referred to, depicts a bogie 10 used by a rail vehicle, and in particular by a locomotive. The bogie 10 comprises a bogie frame 12, two wheelsets 14 each comprising one axle 16 and two wheels 18, a primary suspension 19 connecting the wheelsets 14 to the frame 12 and at least one drive unit 20. In the case of locomotives, as depicted in FIG. 1, two drive units 20 are generally provided to generate more tractive power.

The frame 12 is made of two structural side-members 22 and at least one structural central cross-member 24 joining both side-members 22 at their mid-length or center. In the present example of bogie 10, each extremity 26 of the side-members 22 is also connected together by two more end cross-members 28. This type of arrangement of bogie frame 12 is often seen in locomotive bogies.

A mid-distance between the two axles 16 defines the center of the bogie 10. The central cross-member 24 is located substantially at the center of the frame 12, or basically equidistant from both wheelsets 14. Since the bogie 10 is typically constructed mostly symmetrically on both sides of the central cross-member 24, a weight of the rail vehicle body resting on the bogie 10 (usually resting on two bogies 10) is distributed substantially evenly over the four wheels 18 of each bogie 10.

A push-pull rod 29 is connected at one end to the bogie frame 12 and at its other end to the locomotive chassis, or more generally to the rail vehicle chassis. The push-pull rod 29 is used to transfer traction loads between the bogie 10 and the locomotive chassis. The push-pull rod 29 is typically placed as low as possible in the bogie 10 so as to better transfer the traction load developed at the wheel/rail interface.

Figure 2:
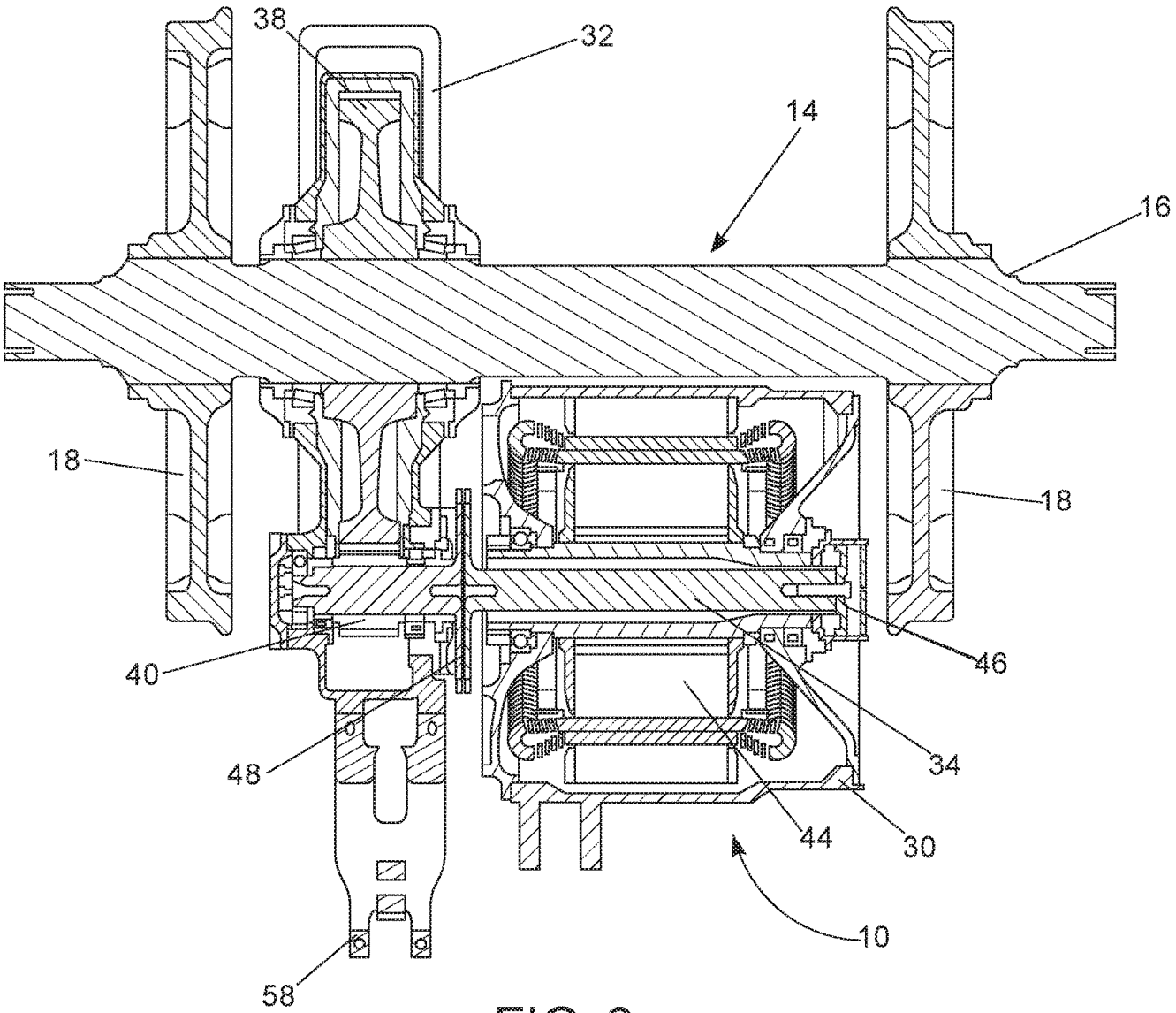
FIG. 2 is a partial cross-sectional top view of a drive unit and a wheelset of the bogie of FIG. 1.
Figure 3:
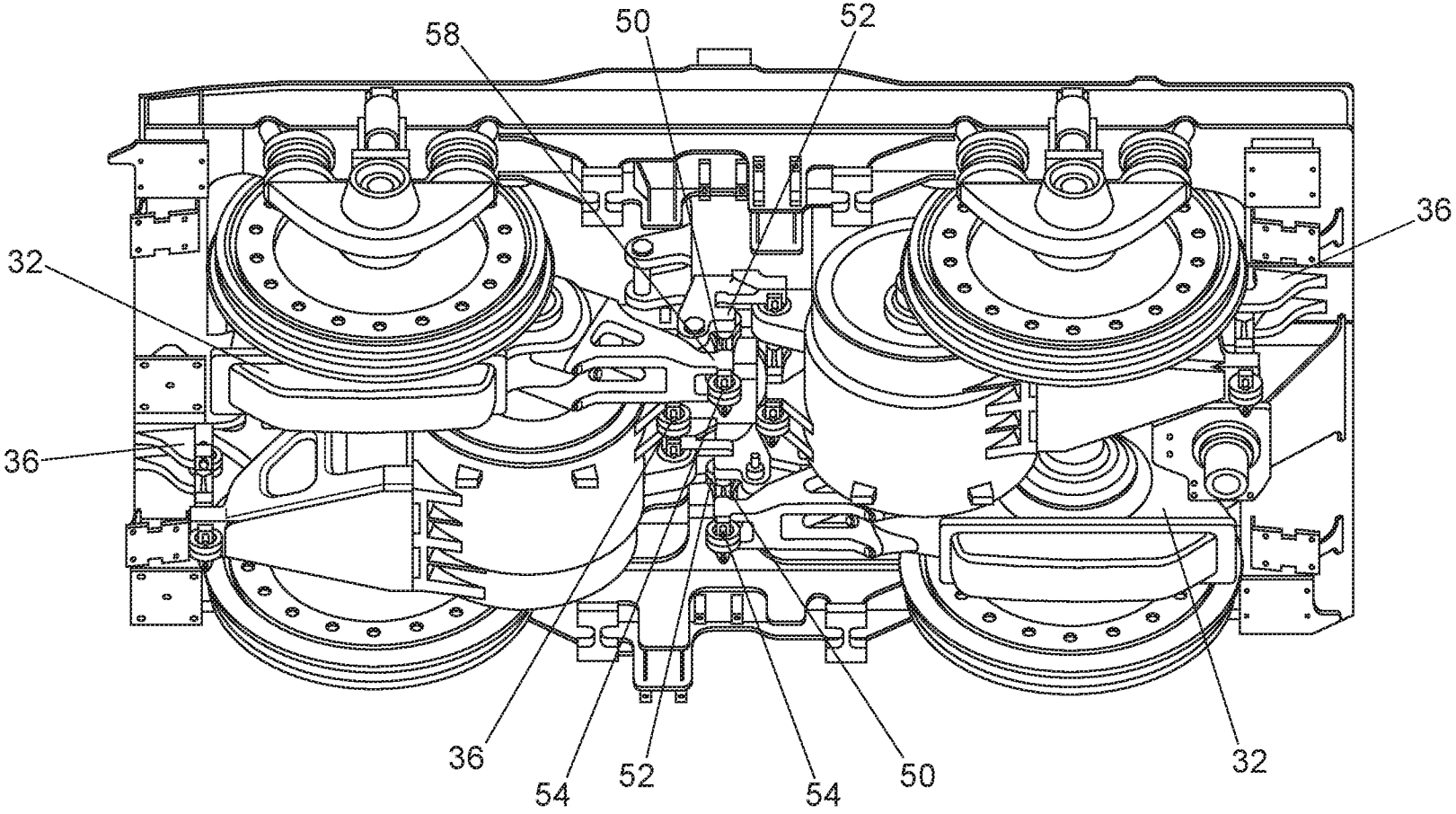
FIG. 3 is an axonometric view from the bottom of the bogie of FIG. 1.

Since the present non-limiting example described a locomotive bogie, references will be made to two drive units 20. However, this should not be considered as limiting since bogies for applications other than for a locomotive may use a single drive unit 20. The drive units 20 are mounted both to the frame 12 and to a respective one of the wheelsets 14, in particular to the respective axles 16 of the wheelsets 14. Each drive unit 20 comprises a motor 30, a gearbox 32 and a driveshaft 34, which is best shown in FIG. 2, now concurrently referred to. The motor 30 is at least partially supported by the frame 12 at the motor mounting points 36. In the present example, the motor 30 is completely and solely supported by the frame 12. The gearbox 32 has a main gear 38 mounted on its axle 16 as well as a pinion 40 driving the main gear 38. Both the main gear 38 and the pinion 40 may use different combinations of number of teeth, thereby varying the gearbox ratio. Because the main gear 38 is mounted on the axle 16, the gearbox 32 is partially supported by the wheelset 14, thereby contributing to the unsprung mass of the bogie 10. However, because the gearbox 32 is also supported on the frame 12 at a gearbox mounting point 58, another portion of the gearbox weight contributes to the suspended mass of the bogie 10. Portions of the gearbox weight contributing to either the unsprung mass and to the suspended mass depend on the gearbox own weight distribution (i.e. the gearbox center of mass) and on the distance between this center of mass and both the axle 16 and the gearbox mounting point 58, best shown in FIG. 3, now concurrently referred to.

The driveshaft 34 is flexibly attached at one end to a rotor 44 of the motor 30 and resiliently at the other end to the pinion 40. In the present description, the term flexibly, flexible, resiliently or resilient should be interpreted to mean that it is adaptable in the sense that the connection may accommodate misalignments between components. Because there is a relative movement between the motor 30, which is solely mounted on the bogie frame 12, and the gearbox 32, which is partially mounted on the suspended frame 12 and partially on the non-suspended wheelset 14, the driveshaft 34 must be mounted so as to compensate for this misalignment between these two components when the frame 12 moves up and down on the primary suspension 19. This misalignment compensation (or angular compensation) is achieved by using, for example, a spherical connection 46 between the driveshaft 34 and the rotor 44 and a flexible disc connection 48 between the driveshaft 34 and the pinion 40. The driveshaft 34 is connected to the rotor 44 on the side of the rotor 44 that is farther from the gearbox 32 and extends through the hollow rotor 44 to reach the pinion 40. This allows the use of a longer driveshaft 34, which in turn requires a smaller angular misalignment between the driveshaft 34 and both the rotor 44 (or motor 30) and the pinion 40 (or gearbox 32). In operation, the driveshaft 34 transfers a torque generated by the motor 30 to the pinion 40.

Figure 4:
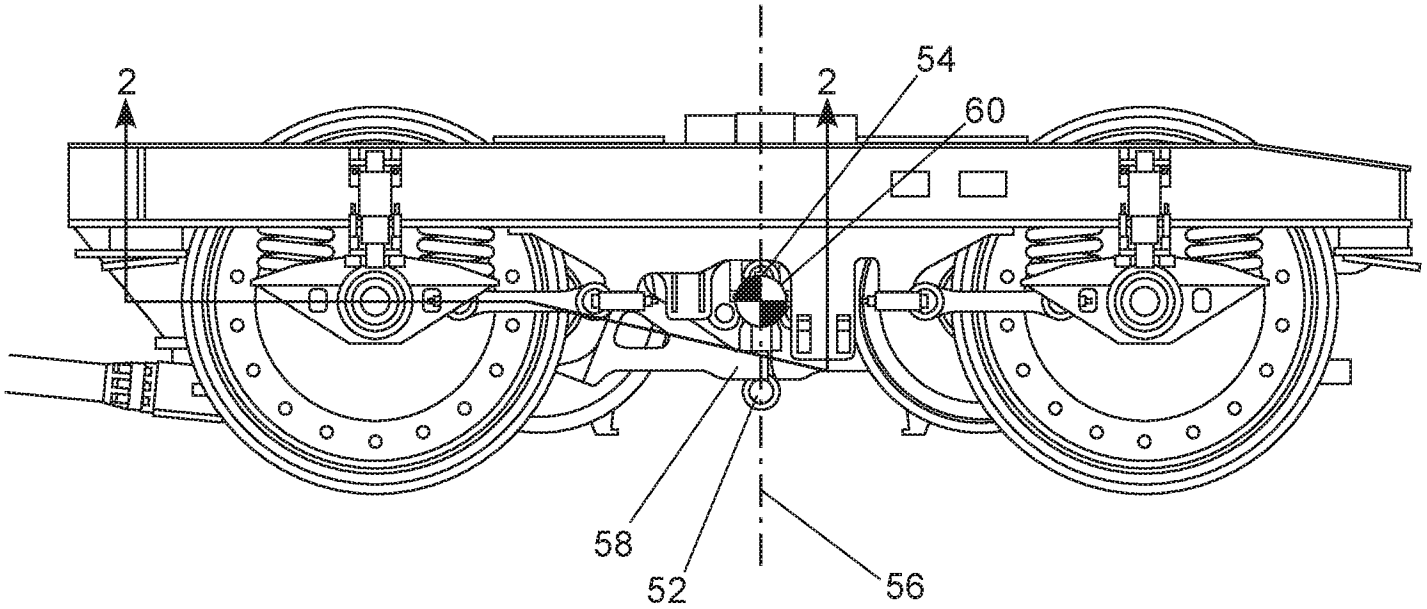
FIG. 4 is a side view of the bogie of FIG. 1.

When transferring the torque to the main gear 38, the pinion 40 wants to roll on the main gear 38 and rotate the gearbox 32. To prevent the gearbox 32 from rotating around the axle 16, a reaction rod 50 must be installed between the gearbox 32 and the frame 12. Each gearbox 32 is equipped with its own reaction rod 50. Each reaction rod 50 has a first end 52 and a second end 54 defining an axis 56 passing by both ends. This is best shown in FIG. 4, now concurrently referred to. The reaction rod 50 is connected to the bogie frame 12 at its first end 52 and to a gearbox mounting point 58 of the gearbox 32 at its second end 54. When projected in a longitudinal-vertical plane bisecting the bogie 10 (the longitudinal-vertical plane is in the same plane as the side view of FIG. 4 but passing through a center of the bogie 10), the reaction rods 50 are aligned so that their respective axis extends substantially through a center 60 of the bogie 10. The center 60 of the bogie 10, which may be defined as a geometrical center 60, may be longitudinally located at a mid-distance between the first and the second wheelsets 14 and, in the vertical direction, substantially at a height of the spinning axes of the axles 16 of the first and the second wheelsets 14. The center 60 of the bogie 10 typically corresponds substantially with a center of gravity of the bogie 10, although not necessarily. Indeed, during the design of the bogie 10, it may be difficult to exactly predict where its center of gravity will end up being located. Consequently, components may be placed relative to the geometrical center 60. Experience tells that the center of gravity typically ends up being close to the geometrical center 60. Consequently, the center 60 may be either the geometrical center 60 as defined above, or the center of gravity of the bogie 10.

Figure 5:
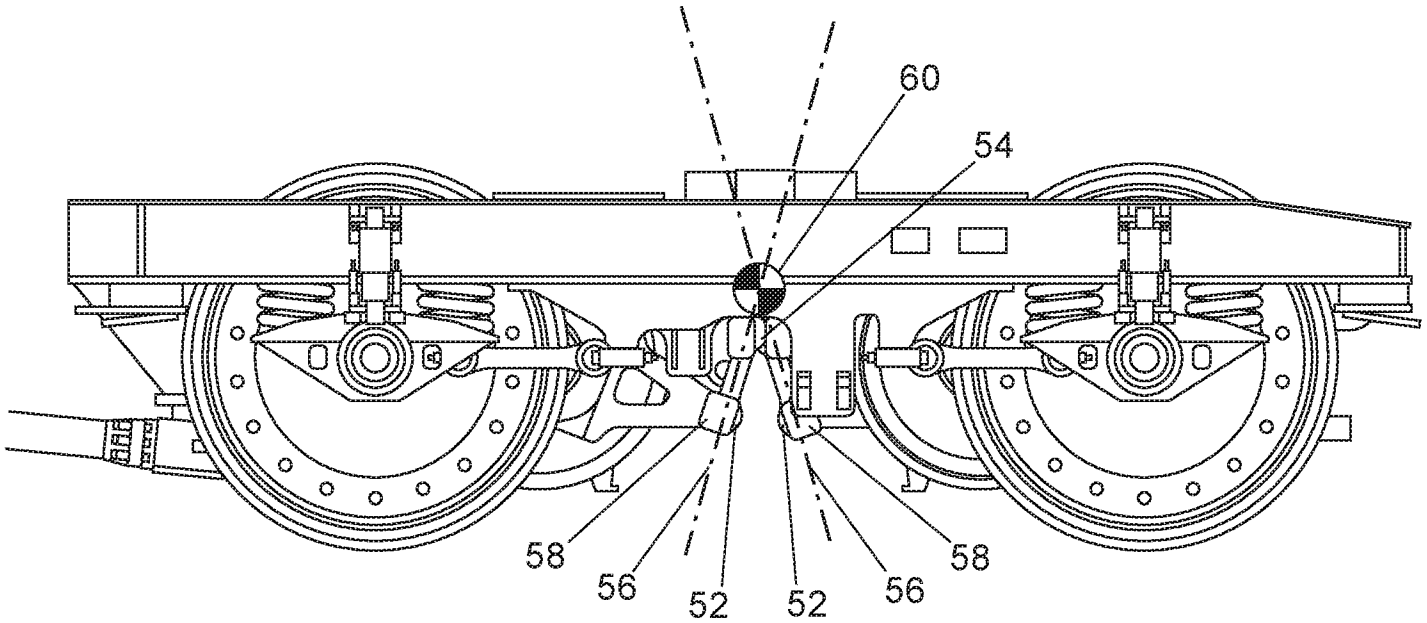
FIG. 5 is a side view of a rail vehicle bogie in accordance with the principles of the present invention.

Although the reactions rods 50 are depicted vertically aligned (i.e. with their respective axis 56 vertical) and positioned substantially halfway between the two wheelsets 14, they do not necessarily have to be configured in such a way. FIG. 5, now concurrently referred to, depicts a variant where the reaction rods 50 are not placed vertically, but are still aligned with the center 60 of the bogie 10. As can be observed, the reactions rods 50 may be at an angle from the vertical direction (z axis) inasmuch as their respective axis 56 passes substantially through the center 60 of the bogie 10. In the variant of FIG. 5, the gearbox mounting point 58 is slightly closer to the pinion 40 than in the variant depicted in FIG. 4.

Although an advantage of positioning the gearbox mounting point 58 close to the pinion 40 may be to reduce the relative movement of the gearbox 32 with respect to the motor 30, other benefits were found by moving the gearbox mounting point 58 away from the pinion 40, inasmuch as the driveshaft 34 may accommodate this misalignment through its end connections. Indeed, moving the gearbox mounting point 58 away from the pinion 40, possibly by a distance at least equivalent to the distance between the pinion 40 and the axle 16, allows reduction of the reaction forces passing through the reaction rods 50. Moreover, aligning (or at least substantially aligning) the respective axis 56 of each reaction rod 50 with the center 60 allows for elimination, or at least a significant reduction, of a pitching torque that the reaction forces passing through the reaction rods 50 would otherwise induce on the bogie frame 12. Indeed, since this pitching torque is equal to the product of the reaction force passing through the reaction rods 50 by the perpendicular distance between the reaction rod's axis and the center 60 of the bogie 10, aligning the reactions rods 50 with the center 60 of the bogie 10 reduces the perpendicular distance (the torque arm) to zero. This eliminates the pitching torque usually developed under the generation of a tractive force when the reaction rods 50 are not aligned with the center 60 of the bogie 10. In turn, eliminating this pitching torque is beneficial as it does not add to the pitching torque already developed by the traction load under the tractive force, which otherwise would further exacerbate the already limited compression of the primary suspension 19. Moreover, eliminating the pitching torque under the tractive force induced by the reaction rods 50 prevents further influencing the weight distribution on the wheels 18. The tractive force is hereby defined as being either positive or negative and may be the consequence of an acceleration, a deceleration or a tractive effort by the motors 30 to compensate for drag, friction, gravitational force (when the vehicle is going uphill or downhill), etc. The tractive effort of the motors 30 may result in an acceleration, a deceleration or a constant speed of the rail vehicle.

The present invention has been described with regard to preferred embodiments. The description as much as the drawings were intended to help the understanding of the invention, rather than to limit its scope. The invention is defined by the claims that follow.

What is claimed is:

1. A bogie for a rail vehicle, the bogie comprising:

a bogie frame;

a first wheelset and a second wheelset each adapted to roll on railway tracks and supporting a different end of the bogie frame;

a first drive unit mounted to the frame and to the first wheelset, the first drive unit having:

a motor at least partially supported by the bogie frame, the motor having a rotor;

a gearbox having a main gear mounted on the first wheelset and a pinion driving the main gear, the gearbox having a mounting point distal from the first wheelset;

a driveshaft attached at one end to the rotor and at the other end to the pinion, the driveshaft being operative to transfer a torque from the motor to the pinion; and a first reaction rod having a first end and a second end defining an axis, the first reaction rod being directly connected to the bogie frame at the first end and to the mounting point of the gearbox at the second end, wherein, when projected in a longitudinal-vertical plane bisecting the bogie, the first reaction rod is aligned so that the axis extends substantially through a center of the bogie.

2. The bogie of claim 1, wherein the reaction rod is positioned substantially halfway between the first wheelset and the second wheelset.

3. The bogie of claim 1, wherein the driveshaft is connected to the rotor on a side of the motor distal to the gearbox and extends through the rotor to attach to the pinion.

4. The bogie of claim 1, wherein the driveshaft is mounted so as to allow a misalignment between the motor and the gearbox.

5. The bogie of claim 4, wherein the driveshaft is connected to the motor through a spherical connection.

6. The bogie of claim 5, wherein the driveshaft is resiliently mounted to a pinion of the gearbox.

7. The bogie of claim 1, wherein the center of the bogie is longitudinally located at a mid-distance between a first spinning axis of the first wheelset and a second spinning axis of the second wheelset.

8. The bogie of claim 7, wherein the center of the bogie is vertically located substantially at a same height as the first spinning axis of the first wheelset.

9. The bogie of claim 7, wherein the center of the bogie is longitudinally located at a mid-distance between the first spinning axis of the first wheelset and the second spinning axis of the second wheelset.

10. The bogie of claim 9, wherein the center of the bogie is vertically located substantially at a same height as the first spinning axis of the first wheelset.

11. The bogie of claim 1, further comprising:

a second drive unit mounted to the frame and to the second wheelset, the second drive unit having:

a motor at least partially supported by the bogie frame, the motor having a rotor;

a gearbox having a main gear mounted on the first wheelset and a pinion driving the main gear, the gearbox having a mounting point distal from the second wheelset;

a driveshaft attached at one end to the rotor and at the other end to the pinion, the driveshaft being operative to transfer a torque from the motor to the pinion; and a second reaction rod having a first end and a second end defining an axis, the second reaction rod being connected to the bogie frame at the first end and to the mounting point of the gearbox of the second drive unit at the second end, the second reaction rod being aligned so that the axis extends substantially through the center of the bogie when projected in the longitudinal-vertical plane.

12. The bogie of claim 11, wherein the second reaction rod is substantially vertically aligned.

13. The bogie of claim 12, wherein the second reaction rod is positioned substantially halfway between the first wheelset and the second wheelset.

14. The bogie of claim 11, wherein the rail vehicle is a locomotive.

* * * * *